US009976729B2

(12) United States Patent
Keogan

(10) Patent No.: US 9,976,729 B2
(45) Date of Patent: May 22, 2018

(54) POT LIGHT ACCESSORY ADAPTOR

(71) Applicant: Kory Keogan, Ottawa (CA)

(72) Inventor: Kory Keogan, Ottawa (CA)

( * ) Notice: Subject to any disclaimer, the term of this patent is extended or adjusted under 35 U.S.C. 154(b) by 9 days.

(21) Appl. No.: 15/103,115

(22) PCT Filed: Dec. 9, 2014

(86) PCT No.: PCT/CA2014/051189

§ 371 (c)(1),
(2) Date: Jun. 9, 2016

(87) PCT Pub. No.: WO2015/085420

PCT Pub. Date: Jun. 18, 2015

(65) Prior Publication Data

US 2016/0320032 A1 Nov. 3, 2016

Related U.S. Application Data

(60) Provisional application No. 61/913,839, filed on Dec. 9, 2013.

(51) Int. Cl.

| | |
|---|---|
| ***F21V 17/00*** | (2006.01) |
| ***F21V 21/04*** | (2006.01) |
| ***F21S 8/02*** | (2006.01) |

(52) U.S. Cl.
CPC ..... *F21V 21/04* (2013.01); *F21S 8/024* (2013.01); *F21S 8/026* (2013.01)

(58) Field of Classification Search
CPC ..... F21V 21/04
USPC ..... 362/364
See application file for complete search history.

(56) References Cited

U.S. PATENT DOCUMENTS

| | | | | |
|---|---|---|---|---|
| 5,836,677 | A * | 11/1998 | Connors | F21S 8/02 362/216 |
| 7,144,137 | B2 | 12/2006 | Liu | |
| 7,618,166 | B1 | 11/2009 | Truax et al. | |
| 2005/0265016 | A1 | 12/2005 | Rappaport | |
| 2007/0211475 | A1 | 9/2007 | Sevack et al. | |

FOREIGN PATENT DOCUMENTS

| | | | |
|---|---|---|---|
| CA | 2114827 | A1 | 8/1995 |
| CA | 2342307 | A1 | 12/2001 |
| CA | 2742437 | A1 | 12/2012 |
| GB | 2450569 | A | 12/2008 |
| WO | WO 2011/095817 | A1 | 8/2011 |

* cited by examiner

*Primary Examiner* — Jamara Franklin
(74) *Attorney, Agent, or Firm* — Muncy, Geissler, Olds & Lowe, P.C.

(57) ABSTRACT

The present invention provides a pot light accessory adapter having a perimeter rim, a flange having an aperture and having means for connecting the adapter to a pot light.

14 Claims, 8 Drawing Sheets

POT LIGHT ACCESSORY ADAPTOR

CROSS REFERENCE TO RELATED APPLICATIONS

This application is a National Stage of International Application No. PCT/CA2014/051189, filed on Dec. 9, 2014; and this application claims priority to U.S. Provisional Application No. 61/915,839 filed on Dec. 9, 2013, the entire contents of all of which are hereby incorporated by reference.

FIELD OF THE INVENTION

The present invention pertains to the field of commercial and residential light fixtures. More specifically, it relates to an accessory adapter that can connect with different sizes of recessed light fixtures.

BACKGROUND

Recessed lights are popular choices for both residential and commercial lighting applications. Recessed lights, also commonly known as "pot lights", "can lights" or "downlights", provide spotlight-type lighting while offering a low-profile arrangement.

Recessed lights generally are made of two parts—the housing and the trim. The housing is the unit that is installed in the ceiling or the wall, and the trim is the part visible to persons inside the space in which the recessed lights project the lighting.

Over time, recessed lights were made in different sizes. Consumer demands for different types of lamps, different lighting features, and aesthetic designs, have driven recessed light manufacturers to produce recessed lights of various sizes. The variation applies to the housing, the trim, and the light bulb. Despite the diversity of recessed lights, currently, 3", 4", and 5" recessed lights are the most common in the market place.

Further, recessed light accessories have been developed, such as those disclosed in CA 2742439 to the present inventor, which can alter the aesthetic appearance or the lighting function of a standard pot light, which are otherwise rather limited. These accessories attach to a standard pot light in a number of ways, including mounting directly to the flange of the pot light.

The variety of available pot light sizes can confront consumers with a fitting problem because not all pot light accessories are manufactured in the commonly available pot light sizes. For example, a consumer may be reluctant to forgo either the optimum choice for a pot light accessory in order to maintain the optimum choice for trim housing, a pot light fixture or a light bulb.

CA 2,114,827 to Lecluze discloses a recessed light housing containing a vertically adjustable socket to which a light bulb is installed. The vertical socket includes a series of vertically spaced slots on opposite side of the socket to which an arm element may be inserted to allow raising or lowering of the socket.

Accordingly, there is a need for a pot light accessory adapter that can connect to various sizes of recessed lights components.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a pot light accessory adapter. In at least one embodiment of the present invention there is provided a pot light accessory adapter having a flange, the flange having a centrally located aperture, a perimeter rim, the perimeter upwardly projecting from an outer edge of the flange, an upper edge of the perimeter rim abutting a ceiling having a pot light, and means for connecting said pot light accessory adapter to a pot light.

Another object of the present invention is to provide a variable diameter pot light accessory adapter. In accordance with at least one embodiment of the present invention, there is provided, a variable diameter pot light accessory adapter having a perimeter rim, and at least one arm having a first end and a second end, the arm pivotable at a pivot point located on the arm, the arm connected to the perimeter rim, the second end having means for connecting the adapter to a pot light.

BRIEF DESCRIPTION OF THE FIGURES

Embodiments of the present invention will be better understood in connection with the following Figures, in which.

DETAILED DESCRIPTION OF THE INVENTION

Definitions

Figure 1:
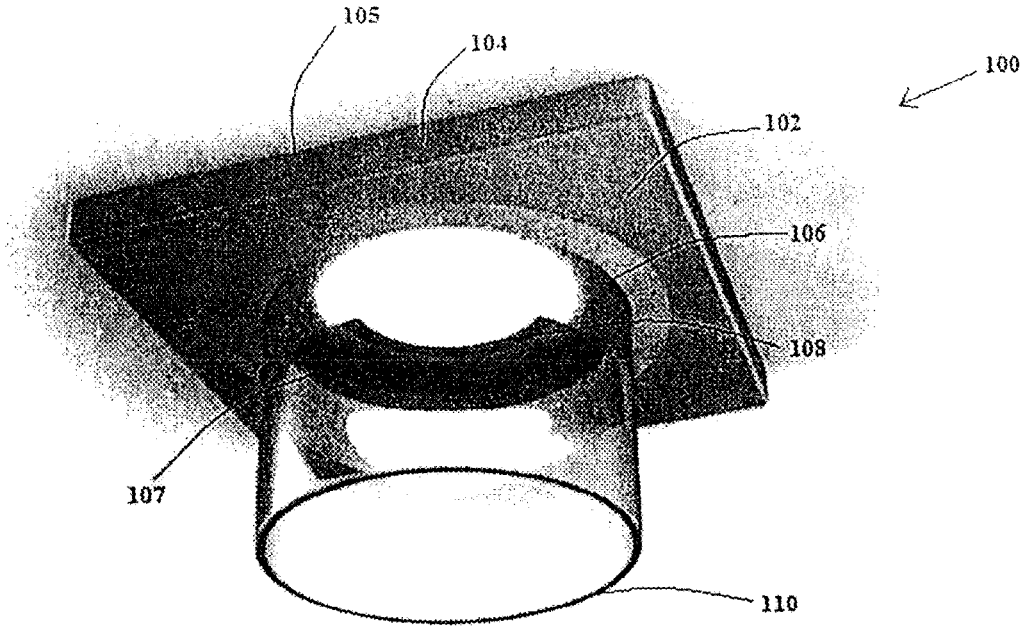
FIG. 1 is an isometric view of a pot light accessory adapter in accordance with an embodiment of the present invention.

Unless defined otherwise, all technical and scientific terms used herein have the same meaning as commonly understood by one of ordinary skill in the art to which this invention belongs.

The present invention provides a pot light accessory adapter for connecting to a variety of sizes of installed pot lights. In at least one embodiment, the pot light accessory adapter has a flange, an aperture within that flange, a perimeter rim that upwardly projects from an outer edge of the flange to abut a ceiling having an installed pot light and means for connecting the accessory adapter to the installed pot light.

In this embodiment, the perimeter rim and flange can be formed of any suitable materials, and further can be formed of a single unitary component or alternatively can formed of separate elements suitably joined together, as will be readily understood by the skilled person. In at least one embodiment, the perimeter rim and flange can be formed of a heat-resistant material such as metal or heat-resistant silicone. In at least one embodiment, the flange has an upper, interior surface and a lower, exterior surface.

It is contemplated that the perimeter rim can upwardly project in a substantial manner, and in other embodiments the perimeter rim may upwardly project in a very slight manner.

In some embodiments, it is contemplated that a gasket is included at an upper edge of the perimeter rim such that the interface between the perimeter rim and the ceiling is effectively sealed to prevent any light from escaping through this interface. This gasket could be manufactured from any suitable material, including foam, plastic or rubber.

In some embodiments, it is contemplated that the perimeter rim can be flexible and/or flexibly connected to the flange, such that when the pot light accessory adapter is installed the perimeter rim is flexibly biased against the ceiling such that the interface between the upper edge of the perimeter rim and the ceiling is effectively sealed to prevent any light from escaping through this interface.

In some embodiments, it is contemplated that the aperture further includes an aperture fixture that is designed to let light pass through the aperture. Non-limiting examples of such aperture fixtures include a frosted glass panel, and downwardly projecting glass cylinder, a metal screen, a decorative globe, among other aperture fixtures that will be readily understood by the skilled person. It is contemplated that the aperture fixture could be removable or alternatively it could be permanently mounted to the accessory adapter.

In some embodiments it is contemplated that the upper, interior surface of the flange further includes at least one raised concentric ring that surrounds the aperture. In some embodiments it is contemplated that this at least one concentric ring can extend upwardly far enough to abut the ceiling or the external flange of a potlight, thereby preventing light leakage between the concentric ring/ceiling interface in a radial direction relative to the aperture and instead directing light downwardly through the aperture.

It is contemplated that the means for connecting the accessory adapter to the installed pot light could be mounted directly to an interior surface of the flange, on the perimeter rim, or at any other suitable location on the accessory adapter. Non-limiting examples of means that could be used to attach the accessory adapter to the installed pot light include magnets, Velcro, mechanical fastening means such as clips, rivets or screws, among other fastening means that will be readily understood by the skilled person. In at least one embodiment, it is contemplated that the means to attach the accessory adapter to the pot light is a magnet that is adapted to attach to the external decorative flange or rim of the pot light. In at least one embodiment, it is contemplated that pot light itself may be adapted to receive the accessory adapter by any known means that will be readily appreciated by the skilled person.

In some embodiments, it is contemplated that the means for connecting the accessory adapter to the installed pot light include an inwardly projecting second flange. This inwardly projecting second flange inwardly projects from the upper edge of the perimeter rim, and can include a second aperture that allows light to stream from the pot light, through the second aperture of the second flange, and through the aperture of the flange to the environment where the accessory adapter is installed.

It is contemplated that the flange can have any suitable shape, including but not limited to circular, elliptical, rectangular, square, round square, round rectangular, triangular and round triangular. It is also contemplate that the flange can be discontinuous or continuous. Further, it is contemplated that the flange may be inwardly concave or outwardly convex, among other arrangements that will represent mere design choices readily apparent to the skilled person.

Similarly, it is contemplated that perimeter rim can take a wide variety of shapes and the shape chosen will vary at least in part based on the shape of the flange that is selected for the particular embodiment.

Further, it is contemplated that the aperture can take any suitable shape including but not limited to a pin hole or plurality of pin holes, a decorative cut out, circular cut out, elliptical cut out, rectangular cut out, square cut out, round square cut out, round rectangular cut out, triangular cut out and round triangular cut out.

In another embodiment of the present invention the accessory adapter has a perimeter rim and at least one arm pivotably connected to the first rim. In some embodiments, it is contemplated that the adapter has three arms, among other arrangements that will readily be understood by the skilled person.

It is contemplated that in this embodiment the perimeter rim can take any shapes (including but not limited to elliptical, circular, square, triangular, rectangular) and can have any cross sectional shape. The perimeter rim can be a continuous perimeter shape (such as an annular circle) or a discontinuous partial perimeter shape, such as a flat "U"-shaped flange. In at least one embodiment, the perimeter rim is a flat annular circle.

The perimeter rim and flange can be formed of any suitable material and by any suitable manufacturing method that will be readily understood by the skilled person. The perimeter rim and flange and be formed of one unitary piece or alternatively can be formed of multiple pieces suitably joined together.

It is contemplated that in some embodiments the perimeter rim can be formed integrally with at least one exterior light fixture accessory (such as but not limited to a light diffuser, a globe, a lantern, a decorative screen, a trim housing and a lamp shade) or alternatively it is contemplated that the perimeter rim is a separate component from an exterior light fixture and is suitably attached by any known means that will be readily apparent to the skilled person. It is contemplated that only one exterior light fixture accessory is attached to perimeter rim, however in some embodiments it is contemplated that two or more external light fixtures are included on the variable diameter pot light accessory adapter of the present invention. It is contemplated that the exterior light fixture accessory could be It is contemplated that the arm has a first end and a second end. The arm can be a straight element or alternatively could by an arcuate element, among other arrangements that will be readily understood by the skilled person. The first end is pivotably connected to the perimeter rim by any suitable means, included formed interfitting components, screws and rivets, among other suitable arrangements. In at least one embodiment, the first end pivots relative to the perimeter ring about a rotation axis that is parallel to a central axial axis that runs through the approximate geometric center of the perimeter rim. In at least one embodiment, it is contemplated that pot light itself may be adapted to receive the accessory adapter by any known means that will be readily appreciated by the skilled person.

In some embodiments it is contemplated that the arm pivots at a pivot point between the first end and the second end. In this embodiment, the first end is fixed relative to the perimeter rim. In these embodiments, the arm can be attached to the perimeter rim at any point between the pivot point and the first end of the arm. In other embodiments, it is contemplated that the pivot point is located at the first end of the arm and the arm is connected to the perimeter rim at the first end of the arm such that the arm is pivotably connected to the perimeter rim.

The second end of the arm includes means for attaching the adapter to a pot light. Non-limiting examples of means that could be used to attach the adapter to the pot light include magnets, Velcro, mechanical fastening means such as clips, rivets or screws, among other fastening means that will be readily understood by the skilled person. In at least one embodiment, it is contemplated that the means to attach the adapter to the pot light is a magnet that is adapted to attach to the external decorative flange or rim of the pot light.

In some embodiments, it is contemplated that the perimeter rim includes at least one first slot that receives a first mating element on one end of the arm such that the arm can both pivot relative to and translate along the first slot. In some embodiments it is contemplated that the first slot is straight and in other embodiments it is contemplated that the first slot is arcuate.

In some embodiments, it is contemplated that the perimeter rim further contains at least one second slot and the arm contains a second mating element located between the first end and the second end that is received in the second slot such that the second mating element (and accordingly the attached arm) can pivot relative to and translate along the second slot. In some embodiments it is contemplated that the second slot is straight and in other embodiments it is contemplated that the second slot is arcuate.

It is contemplated that the first mating element and the second mating element can be any known means that permit the mating elements to pivot relative to and translate along the respective receiving slots.

In this way, the arm can pivot relative to the perimeter rim such that the second end of the arm can be moved from a first position (adjacent the perimeter rim) to a second position closer to the approximate geometric centre of the perimeter rim.

In some embodiments it is contemplated that the perimeter rim further includes at least one retention arm that secures the arm in any desired position. It is also contemplated that the perimeter rim includes a housing slot along a proximal perimeter edge of the perimeter arm that is adapted to receive the means for connecting the adapter to the pot light when the arm is in the first position.

To gain a better understanding of the invention described herein, the following examples are set forth. It will be understood that these examples are intended to describe illustrative embodiments of the invention and are not intended to limit the scope of the invention in any way.

EXAMPLES

Example 1

Turning to FIGS. 1, 2, 3 and 4, several different embodiments of a pot light accessory adapter 100 are illustrated in accordance with the present invention. With reference to FIG. 1, pot light accessory adapter 100 has a flange 102 that has a square shape and has an aperture 106 that is circular. Perimeter rim 104 upwardly projects from flange 102 to abut the ceiling. In this embodiment, means for connecting said pot light accessory adapter to the pot light include a second flange 107 that inwardly projects from the upper edge 105 of projecting rim 104. Second flange 107 has a second aperture 108 that is circular. In this embodiment, an aperture fixture 110 is provided that is cylindrical, transparent and downwardly projecting from aperture 106.

Figure 2:
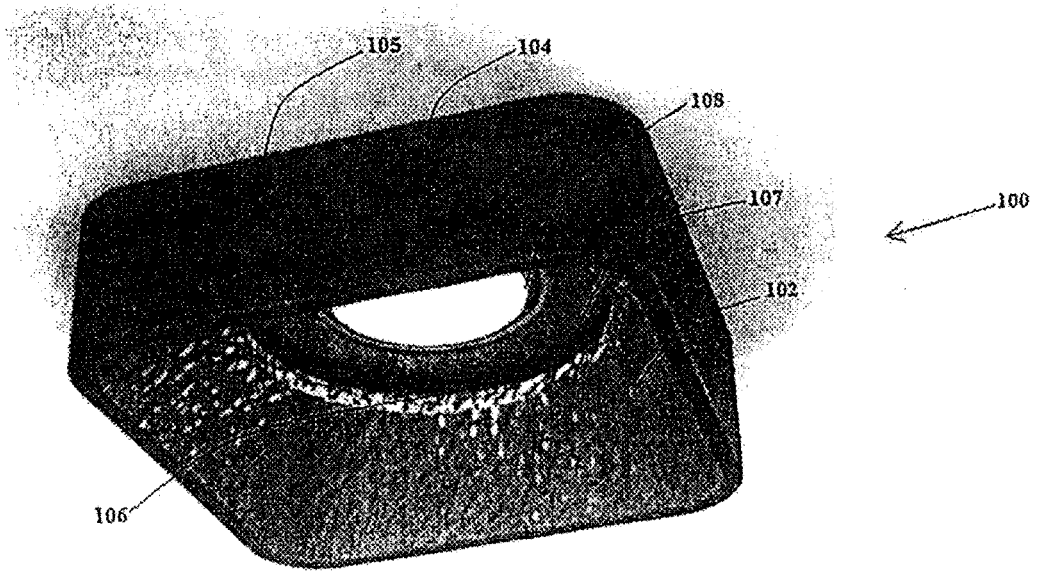
FIG. 2 is an isometric view of another pot light accessory adapter in accordance with an embodiment of the present invention.

Turning to FIG. 2, pot light accessory adapter 100 has a flange 102 that is inwardly concave, has a rounded square shape and has an aperture 106 that is circular. Perimeter rim 104 upwardly projects from flange 102 to abut the ceiling. In this embodiment, means for connecting said pot light accessory adapter to the pot light include a second flange 107 that inwardly projects from the upper edge 105 of perimeter rim 104. Second flange 107 has a second aperture 108 that is circular.

Figure 3:
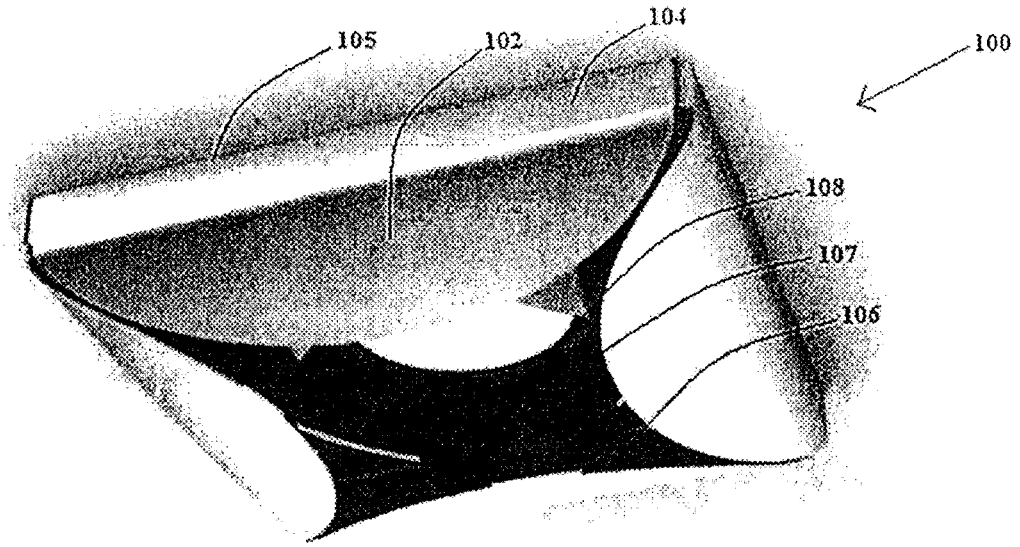
FIG. 3 is an isometric view of another pot light accessory adapter in accordance with an embodiment of the present invention.

Turning to FIG. 3, pot light accessory adapter 100 has a flange 102 that is discontinuous in shape and has an discontinuously shaped aperture 106. Perimeter rim 104 upwardly projects from flange 102 to abut the ceiling. In this embodiment, means for connecting said pot light accessory adapter to the pot light include a second flange 107 that inwardly projects from the upper edge 105 of perimeter rim 104. Second flange 107 has a second aperture 108 that is circular.

Figure 4:
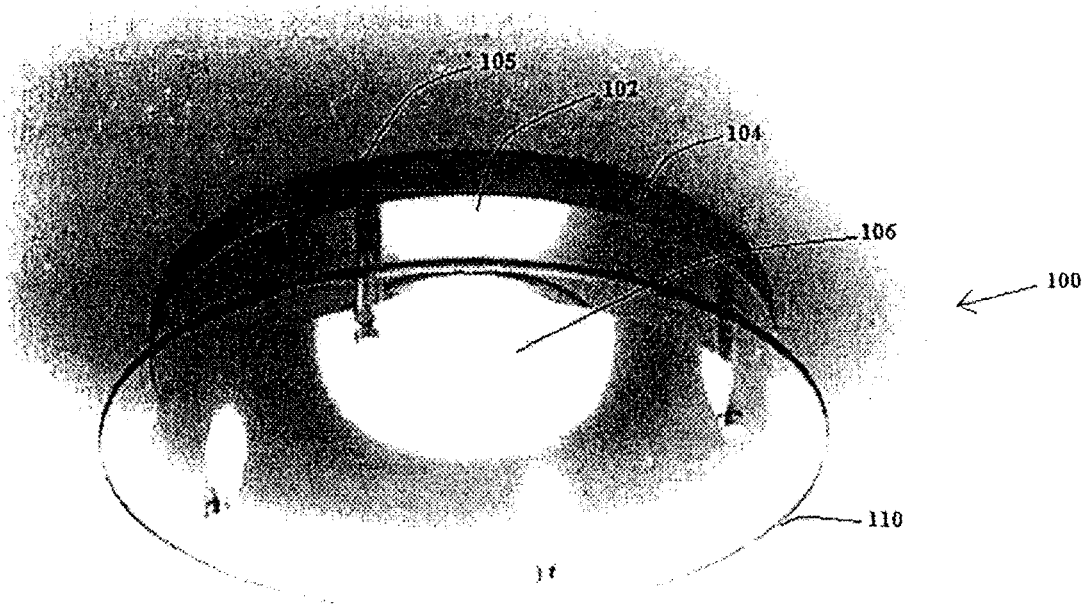
FIG. 4 is an isometric view of another pot light accessory adapter in accordance with an embodiment of the present invention.

Turning to FIG. 4, pot light accessory adapter 100 has a flange 102 that is circular in shape and has a circularly shaped aperture 106. Perimeter rim 104 upwardly projects from flange 102 to abut the ceiling. In this embodiment, means for connecting said pot light accessory adapter to the pot light include a second flange (not shown) that inwardly projects from the upper edge 105 of perimeter rim 104. In this embodiment, an aperture fixture 110 is provided that is a transparent disc and positioned adjacent aperture 106.

Figure 5:
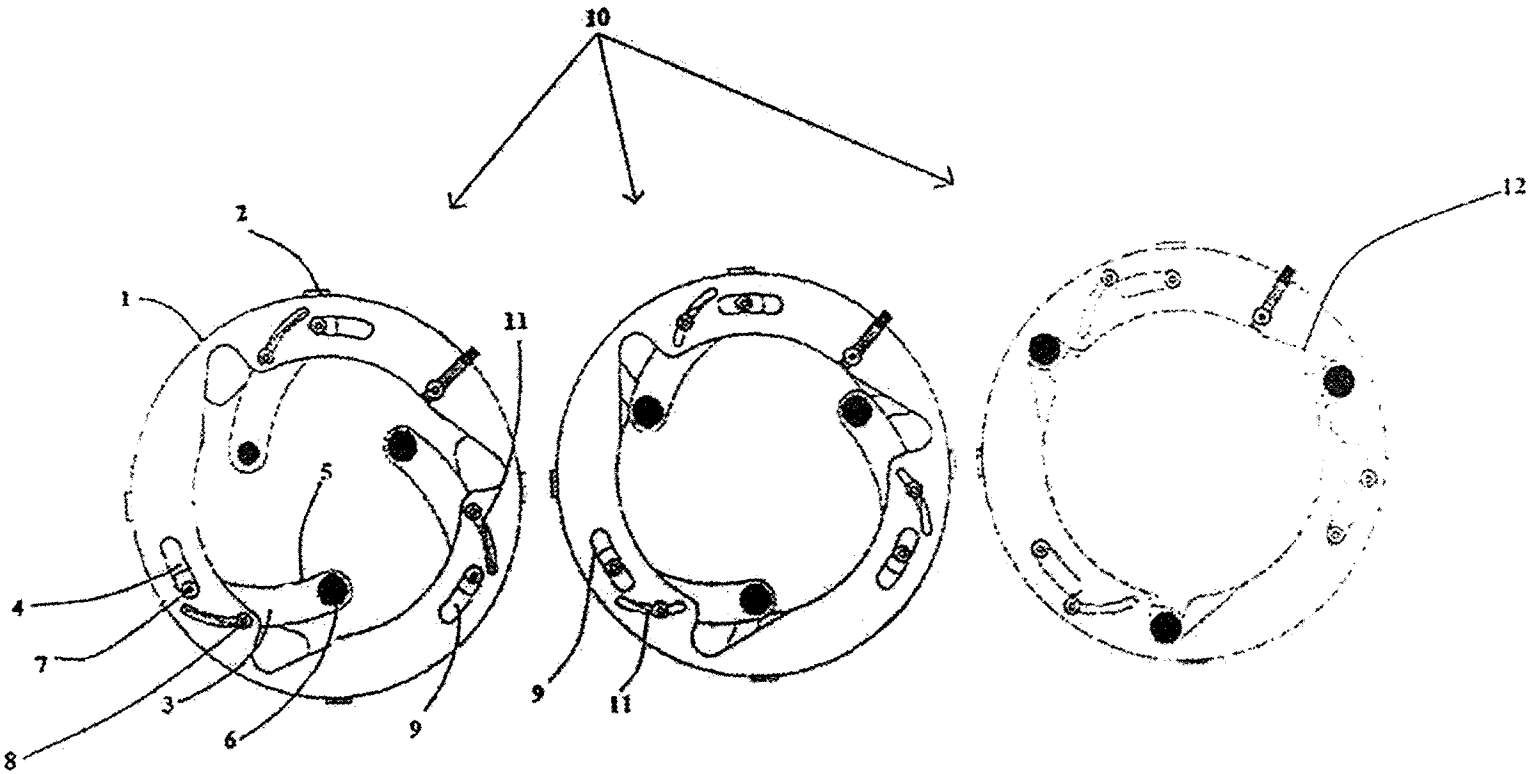
FIG. 5 is a view of a variable diameter pot light accessory adapter in accordance with an embodiment of the present invention, illustrating the arm in a first position, an intermediary position and a second position.
Figure 6:
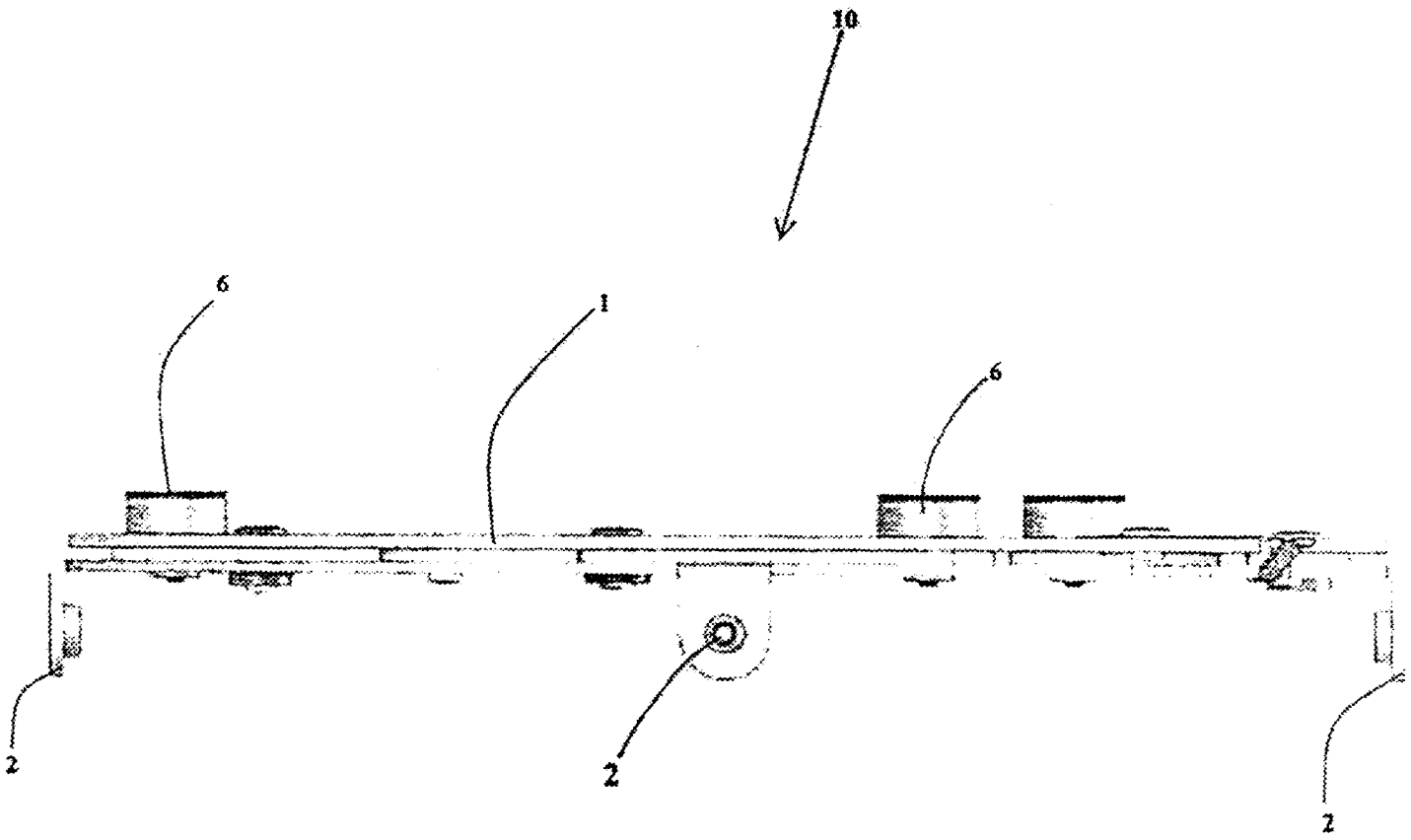
FIG. 6 is a side view of the of the adapter illustrated in FIG. 5.
Figure 10B:
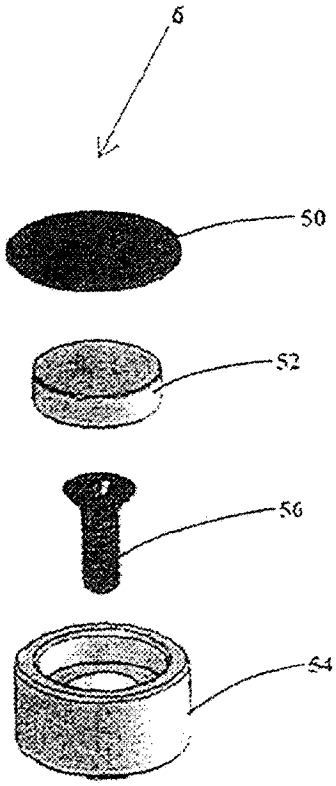
FIG. 10*b* is an exploded view of one embodiment of means for connecting the adapter to a pot light in accordance with an embodiment of the present invention.
Figure 10A:
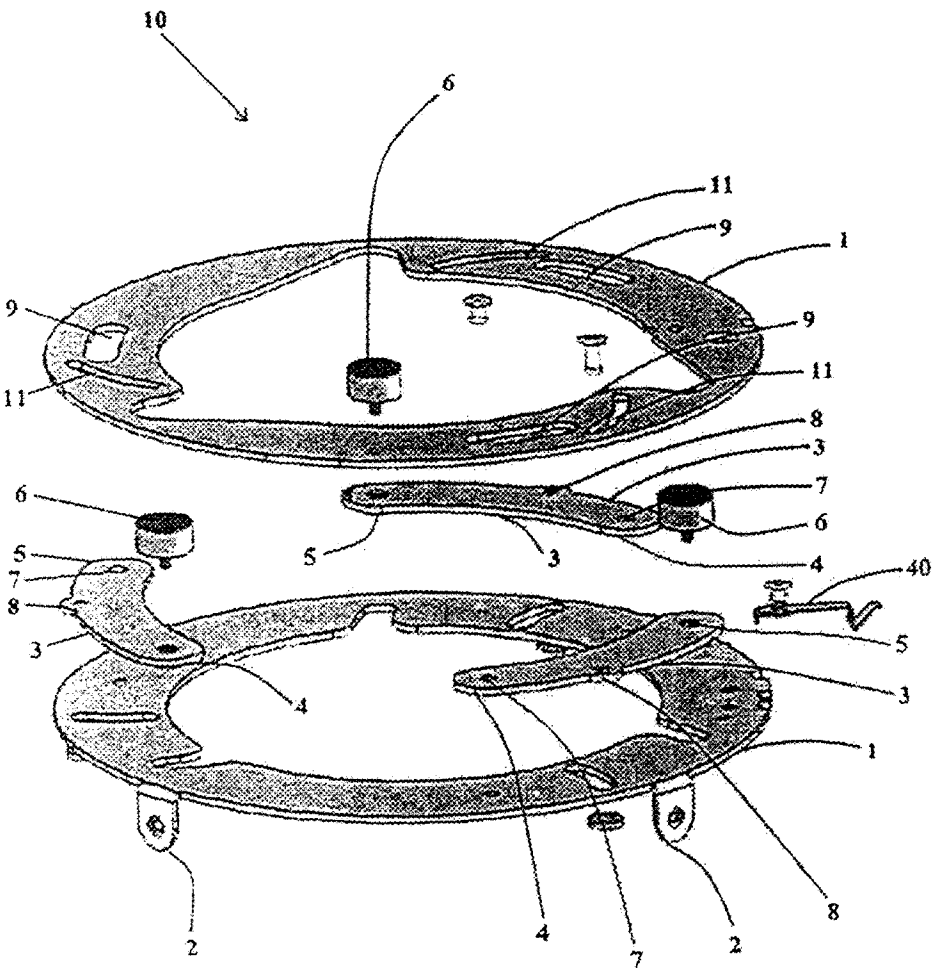
FIG. 10*a* is an exploded isometric view of an adapter in accordance with an embodiment of the present invention.

Turning to FIGS. 5, 6 and 10A, at least one embodiment of a variable diameter pot light accessory adapter 10 in accordance with the present invention is illustrated wherein perimeter rim 1 is an annular circle in shape and assembled from two components. Adapter 10 includes means 2 for attaching the adapter to an external light fixture accessory that are brackets for receiving a mechanical faster, such as a screw.

In this embodiment, adapter 10 has three arms 3 having a first end 4 and a second end 5. Second end includes means 6 for connecting the adapter to a pot light. First end 4 includes a first mating element 7 received in a first slot 9 that is arcuate. Arm 3 also includes a second mating element 8 that is received in second slot 11 that is also arcuate. A housing slot 12 is located on a proximal perimeter edge of perimeter rim 1, that can house means 6 when the arm is in the first position A.

In this way and as seen in FIG. 5, arm 3 can be moved from a first position A where second end 5 of arm 3 is adjacent perimeter rim 1 through an intermediary position B to a second position C where second end 5 of arm 3 is located closer to the geometric centre of perimeter rim 1. During movement, both first mating element 7 and second mating element 8 pivot relative to and translate along first slot 9 and second slot 11, respectively.

Figure 7:
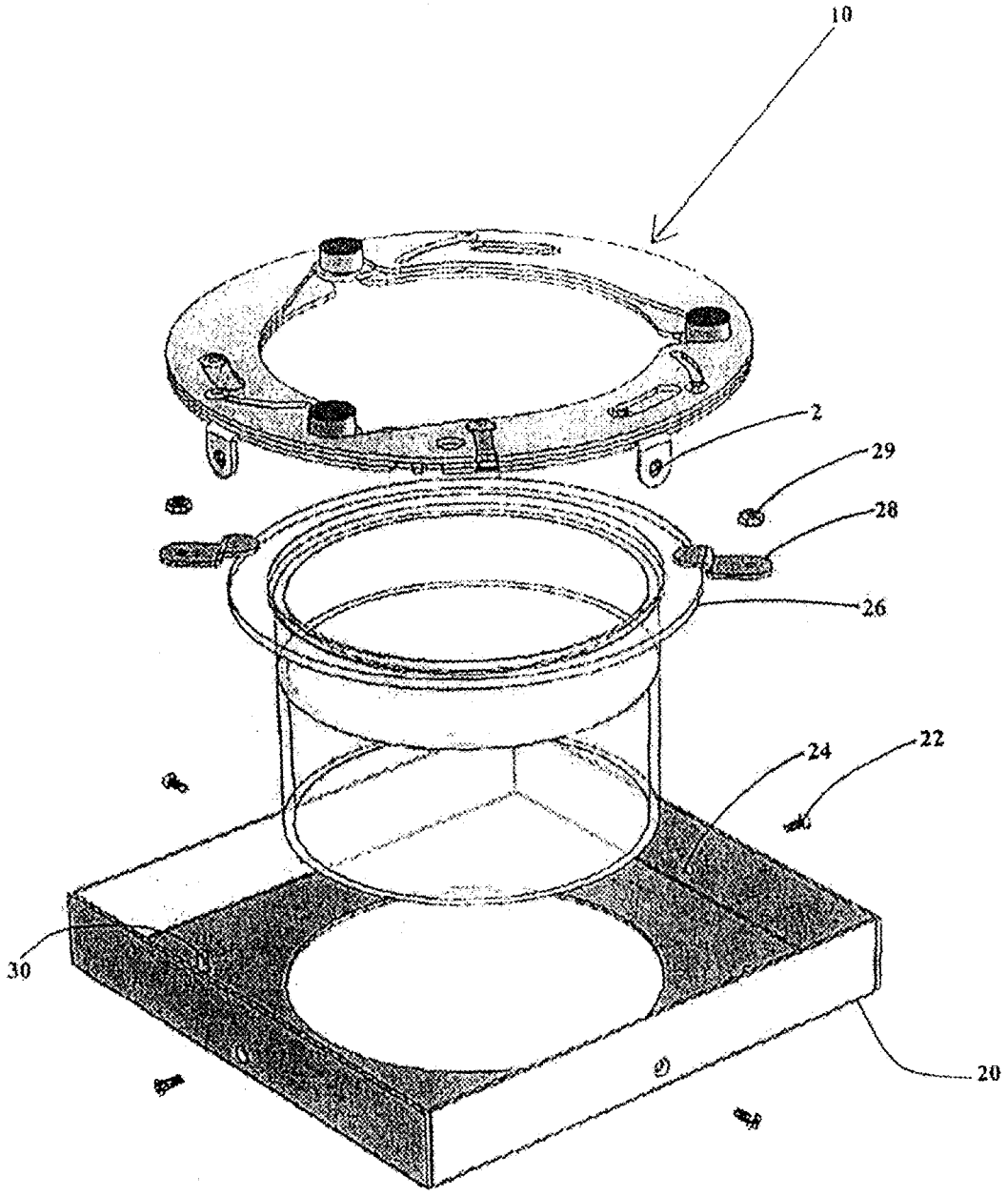
FIG. 7 is an exploded view of an adapter, an external light fixture and a housing unit in accordance with an embodiment of the present invention.
Figure 9:
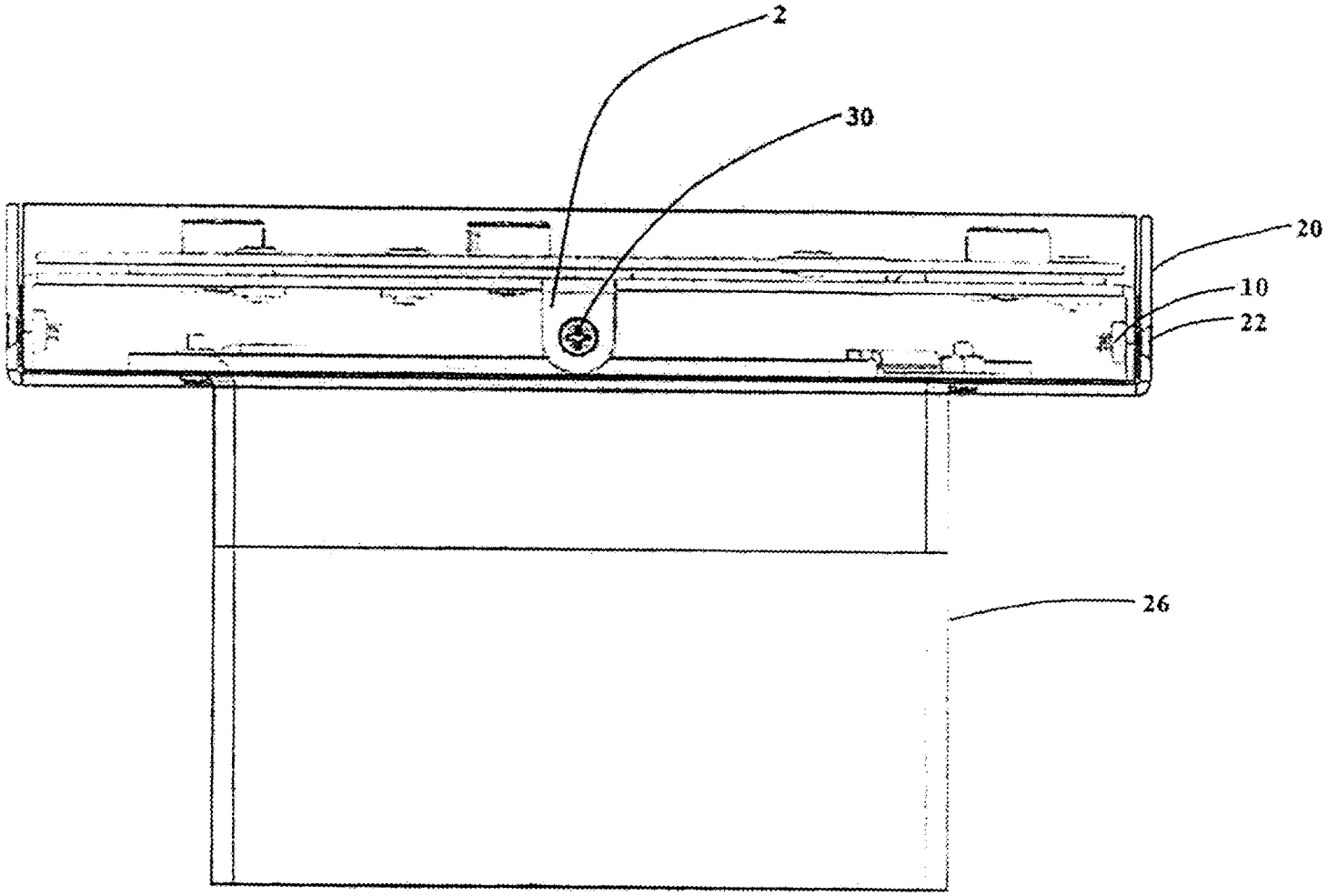
FIG. 9 is a side, cutaway view of an adapter and an external light fixture in accordance with an embodiment of the present invention.

Turning to FIGS. 7 and 9, at least one embodiment of a variable diameter pot light accessory adapter 10 in accordance with the present invention is illustrated wherein an external light fixture accessory in the form of a trim housing 20 mounts to means 2 by way of a screw 22 inserted through hole 24 and secured by nut 23. Further, a second external light fixture accessory in the form of fixture 26 is secured directly to perimeter rim 1 of adapter 10 by way of a clip 28 that is secured by a nut 29 and machine screw 30.

Figure 8:
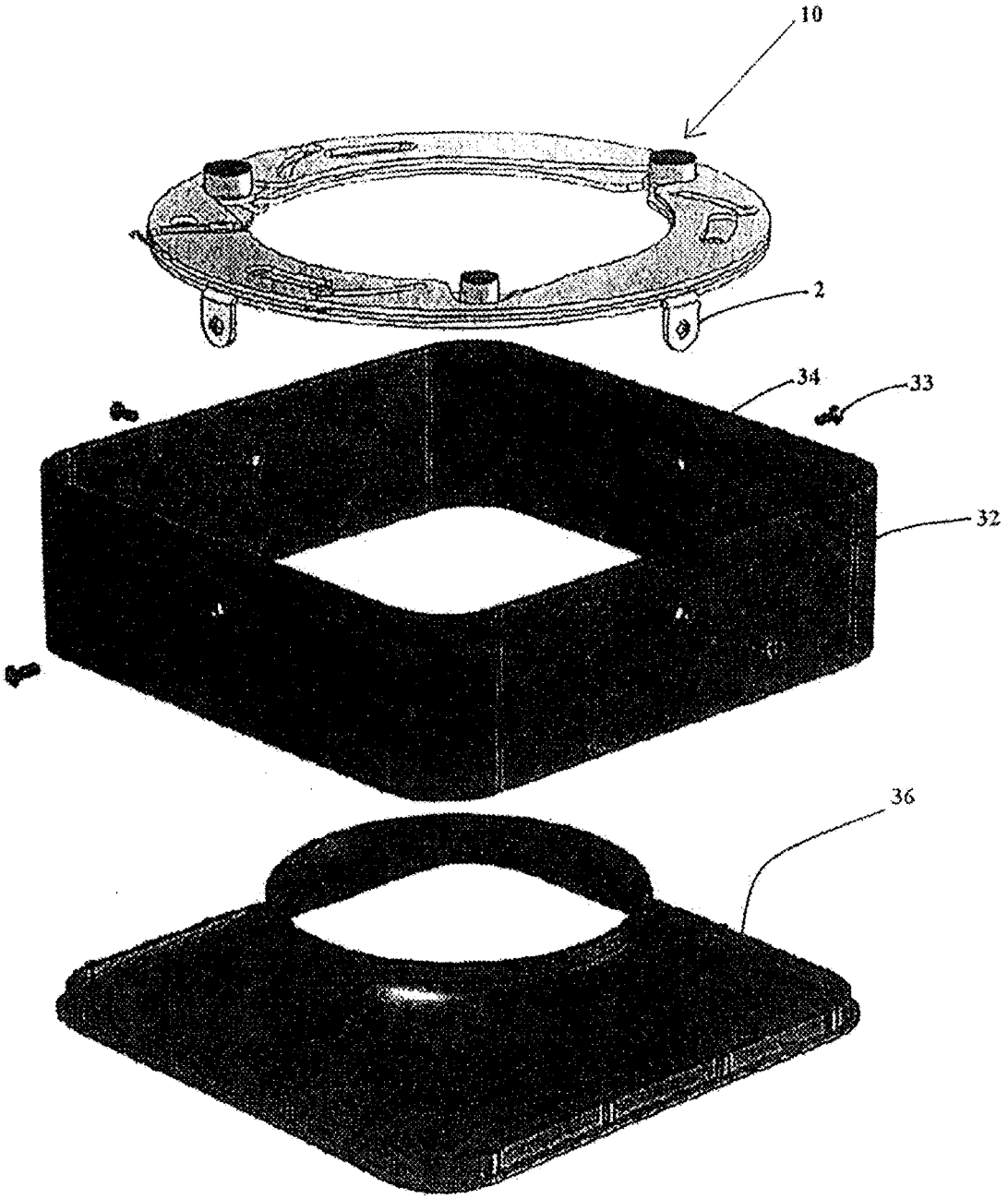
FIG. 8 is an exploded view of an adapter and an external light fixture in accordance with another embodiment of the present invention.

Turning to FIG. 8, at least one embodiment of a variable diameter pot light accessory adapter 10 in accordance with the present invention is illustrated wherein an external light fixture accessory in the form of a trim housing 32 mounts to means 2 by way of a screw 33 inserted through hole 34. Internal trim element 36 press fits into trim housing 32 to complete the external light fixture accessory.

Turning to FIG. 10B, at least one embodiment of means 6 for connecting the adapter to the pot light are illustrated that include a rubber non-slip pad 50 connected to a magnet 52 housed in a cup 54. Magnet 52 and cup 54 are fixed to the second end of the arm by way of a set screw 56.

Although the invention has been described with reference to certain specific embodiments, various modifications thereof will be apparent to those skilled in the art without departing from the spirit and scope of the invention. All such modifications as would be apparent to one skilled in the art are intended to be included within the scope of the following claims.

The embodiments of the invention in which an exclusive property or privilege is claimed are defined as follows:

1. A pot light accessory adapter for connecting to an external flange of a pot light flushly mounted in a ceiling, the pot light accessory adaptor comprising:

a flange, said flange constructed of heat-resistant silicone and having a centrally located aperture, an upper, interior surface and a lower, exterior surface;

a perimeter rim, said perimeter rim constructed of heat-resistant silicone and upwardly projecting from an outer edge of said upper, interior surface of said flange, said perimeter rim having an upper edge; and a connector for connecting said pot light accessory adapter to a pot light said connector being fixed to said upper interior surface of said flange, wherein said perimeter rim is outwardly flexible relative to the pot light and said flange is downwardly flexible relative to the pot light such that when said pot light accessory adapter is installed and said connector is connected to the external flange of the pot light, said upper edge of said perimeter rim is flexibly biased against the ceiling such that light cannot pass between said upper edge of said perimeter rim and said ceiling.

2. The pot light accessory adapter of claim 1, wherein said aperture further comprises an aperture fixture, said aperture fixture adapted to allow at least some light to pass through.

3. The pot light accessory adapter of claim 1, wherein said perimeter rim further comprises a gasket located between said upper edge of said perimeter rim and the ceiling such that light cannot pass between said upper edge of said perimeter rim and the ceiling.

4. The pot light accessory adapter of claim 1, wherein said flange is inwardly concave.

5. The pot light accessory adapter of claim 1, wherein said flange is outwardly concave.

6. The pot light accessory adapter of claim 1, wherein said connector for connecting said pot light accessory adapter to a pot light further comprise an inwardly projecting flange, said inwardly projecting flange having a second aperture, said inwardly projecting flange inwardly projecting from said upper edge of said perimeter rim.

7. The pot light accessory of claim 1 further comprising at least one upwardly projecting concentric ring positioned about said aperture on said upper, interior surface of said flange and wherein an upper edge of said at least one upwardly projecting concentric ring abuts at least one of said ceiling and an external flange of said pot light.

8. A variable diameter pot light accessory adapter comprising:

a perimeter rim; and at least one arm having a first end and a second end, said arm pivotable at a pivot point located on said arm, said arm connected to said perimeter rim, said second end having a connector for connecting the adapter to a pot light.

9. The variable diameter pot light accessory adapter of claim 8, wherein said arm is connected to said perimeter rim at said first end of said arm and said pivot point is located at said first end of said arm such that said arm is pivotably connected to said perimeter rim.

10. The variable diameter pot light accessory adapter of claim 9, wherein said perimeter rim further comprises at least one first slot and said first end of said at least one arm further comprises a mating element, said mating element mating with said at least one first slot such that said at least one arm is both pivotable about and translatable along said at least one first slot and wherein said at least one first slot is arcuate.

11. The variable diameter pot light accessory adapter of claim 10, wherein said perimeter rim further comprises at least one second slot and said at least one arm further comprises a second mating element located between said first end of said at least one arm and said second end of said at least one arm, said second mating element mating with said at least one second slot such that said at least one arm is both pivotable about and translatable along said at least one second slot and wherein said at least one second slot is arcuate.

12. The variable diameter pot light accessory adapter of claim 8, wherein said pivot point is located between said first end and said second end and wherein said arm is connected to said perimeter arm at a point between said pivot point and said first end.

13. The variable diameter pot light accessory adapter of claim 8, wherein said at least one arm pivots at said pivot point about a rotation axis such that said second end is movable from a first position to a second position; and wherein said second end is closer to a central axis of said perimeter rim in said second position than in said first position.

14. The variable diameter pot light accessory adapter of claim 8, wherein said perimeter rim has at least one housing slot located in a proximal perimeter edge of said perimeter rim, said housing slot adapted to receive said connector for connecting the adapter to a pot light when said at least one arm is in said first position and further comprising at least one retention arm, said retention arm adapted for securing said at least one arm.

* * * * *